US010054072B2

(12) United States Patent
Bruestle

(10) Patent No.: US 10,054,072 B2
(45) Date of Patent: Aug. 21, 2018

(54) EXHAUST GAS RECIRCULATION SYSTEM FOR AN INTERNAL COMBUSTION ENGINE

(71) Applicant: Neander Motors AG, Kiel (DE)

(72) Inventor: Claus Bruestle, Nordheim (DE)

(73) Assignee: Neander Motors AG, Kiel (DE)

( * ) Notice: Subject to any disclaimer, the term of this patent is extended or adjusted under 35 U.S.C. 154(b) by 0 days.

(21) Appl. No.: 15/299,710

(22) Filed: Oct. 21, 2016

(65) Prior Publication Data

US 2017/0114737 A1 Apr. 27, 2017

(30) Foreign Application Priority Data

Oct. 23, 2015 (DE) ..... 10 2015 007 393

(51) Int. Cl.
*B63H 21/34* (2006.01)
*F02D 41/00* (2006.01)
(Continued)

(52) U.S. Cl.
CPC ..... *F02D 41/0052* (2013.01); *B63H 20/24* (2013.01); *B63H 21/14* (2013.01);
(Continued)

(58) Field of Classification Search
CPC ..... B63H 20/24; B63H 21/14; F02D 41/0052; F02M 26/05; F02M 26/14; F02M 26/16;
(Continued)

(56) References Cited

U.S. PATENT DOCUMENTS 4,171,689 A 10/1979 Ehelm
5,740,786 A 4/1998 Gartner
(Continued)

FOREIGN PATENT DOCUMENTS

DE 40 07 516 C2 3/1997
DE 196 18 868 A1 11/1997
(Continued)

OTHER PUBLICATIONS

German-language Extended European Search Report issued in countetpart European Application No. 16002178.8 dated Jan. 5, 2017 with partial translation (six (6) pages).

*Primary Examiner* — Stephen P Avila
(74) *Attorney, Agent, or Firm* — Crowell & Moring LLP

(57) ABSTRACT

An exhaust gas recirculation system is provided for an internal combustion engine having reciprocating piston design with an exhaust gas turbocharger unit having an exhaust gas turbine and a supercharger. The internal combustion engine has a machine housing accommodating one or more cylinders having reciprocating pistons, which is provided with a suction unit and an exhaust gas outlet unit, which is connected to the exhaust gas turbine by way of an exhaust gas line. The exhaust gas line supplies at least a part of the exhaust gas stream to the suction unit via the exhaust gas recirculation system. To optimize the exhaust gas recirculation system, it has a pipe branch, which is connected to the exhaust gas line and is connected to an exhaust gas recirculation line with a control element interconnected. The exhaust gas recirculation line extends, on the one hand, with a first supply line section outside and, on the other hand, with a second supply line section in an interior of, a suction unit container of the suction unit. An exhaust gas stream is conveyed by the second supply line section into the suction unit container for targeted mixing of exhaust gases with the air volume contained in the suction unit container.

11 Claims, 6 Drawing Sheets

(51) Int. Cl.

| | |
|---|---|
| ***F02M 35/10*** | (2006.01) |
| ***F02M 35/104*** | (2006.01) |
| ***F02M 26/05*** | (2016.01) |
| ***F02M 26/16*** | (2016.01) |
| ***F02M 26/19*** | (2016.01) |
| ***F02M 26/28*** | (2016.01) |
| ***F02M 26/30*** | (2016.01) |
| ***F02M 26/32*** | (2016.01) |
| ***F02M 26/41*** | (2016.01) |
| ***F02M 26/53*** | (2016.01) |
| ***F02M 26/14*** | (2016.01) |
| ***B63H 20/24*** | (2006.01) |
| ***B63H 21/14*** | (2006.01) |
| ***F02M 35/16*** | (2006.01) |
| *F02B 29/04* | (2006.01) |
| *F02B 37/00* | (2006.01) |

(52) U.S. Cl.
CPC ..... *F02M 26/05* (2016.02); *F02M 26/14* (2016.02); *F02M 26/16* (2016.02); *F02M 26/19* (2016.02); *F02M 26/28* (2016.02); *F02M 26/30* (2016.02); *F02M 26/32* (2016.02); *F02M 26/41* (2016.02); *F02M 26/53* (2016.02); *F02M 35/104* (2013.01); *F02M 35/10222* (2013.01); *F02M 35/165* (2013.01); *B63B 2758/00* (2013.01); *F02B 29/0462* (2013.01); *F02B 37/00* (2013.01); *F02M 35/167* (2013.01)

(58) Field of Classification Search
CPC ..... F02M 26/19; F02M 26/28; F02M 26/30; F02M 26/32; F02M 26/41; F02M 26/53
See application file for complete search history.

(56) References Cited

U.S. PATENT DOCUMENTS

| | | | | |
|---|---|---|---|---|
| 5,957,116 | A | 9/1999 | Haegele et al. | |
| 2007/0131399 | A1 | 6/2007 | Digele | |
| 2007/0289582 | A1 | 12/2007 | Elsasser et al. | |
| 2013/0042840 | A1 | 2/2013 | Braic et al. | |
| 2014/0041385 | A1 | 2/2014 | Wittwer | |
| 2014/0060506 | A1* | 3/2014 | Shaver | F02D 13/0226 123/672 |
| 2014/0190459 | A1* | 7/2014 | Horiuchi | F01P 3/20 123/568.12 |
| 2015/0167594 | A1 | 6/2015 | Jun et al. | |

FOREIGN PATENT DOCUMENTS

| | | | |
|---|---|---|---|
| DE | 198 37 623 | A1 | 3/1999 |
| DE | 101 53 033 | A1 | 5/2003 |
| DE | 10 2006 028 145 | A1 | 12/2007 |
| DE | 10 2010 002 233 | A1 | 8/2011 |
| DE | 10 2013 009 250 | A1 | 12/2014 |
| DE | 10 2014 107 866 | | 8/2015 |
| EP | 1 529 952 | A2 | 5/2005 |
| EP | 1 998 017 | A2 | 12/2005 |
| EP | 2 133 548 | A1 | 12/2009 |
| EP | 2 696 054 | A1 | 2/2014 |
| EP | 2 557 654 | A1 | 4/2015 |
| GB | 2511601 | A | 9/2014 |

* cited by examiner

EXHAUST GAS RECIRCULATION SYSTEM FOR AN INTERNAL COMBUSTION ENGINE

CROSS REFERENCE TO RELATED APPLICATIONS

This application claims priority under 35 U.S.C. § 119 from German Patent Application No. 10 2015 007 393.1, filed Oct. 23, 2015, the entire disclosure of which is herein expressly incorporated by reference.

BACKGROUND AND SUMMARY OF THE INVENTION

The invention relates to an exhaust gas recirculation system for an internal combustion engine of the reciprocating piston design having an exhaust gas turbocharger unit, comprising an exhaust gas turbine and a supercharger.

Nitrogen oxides—NOx—which the internal combustion engine emits, are reduced during the fuel consumption by controlled introduction of combustion gases of an internal combustion engine into the combustion chambers thereof. During combustion of a fuel-air mixture, the formation of nitrogen oxides increases disproportionally with increase of the combustion temperature. The combustion temperature is lowered and nitrogen oxides are reduced by recirculating a part of the exhaust gases.

A diesel engine having an exhaust gas line, in which an exhaust gas turbine of an exhaust gas turbocharger is active, is known, from DE 40 07 516 C2. The latter drives a supercharger, which conveys charge air to combustion chambers of the diesel engine. An exhaust gas recirculation line and an exhaust gas line, which open into a line section before the supercharger, are upstream of the supercharger. Throttles are inserted into the exhaust gas recirculation line and the exhaust gas line, which are used to control an optimum recirculation quantity in the entire operating range of the diesel engine. The exhaust gas line before the throttle is provided with an exhaust gas cooler.

An internal combustion engine having an exhaust gas recirculation system is disclosed in DE 196 18 868 A1, in which an exhaust gas turbine of an exhaust gas turbocharger is arranged in an exhaust gas line and a compressor of said exhaust gas turbocharger is arranged in a combustion air line. In this case, to achieve a negative pressure gradient between an engine exit and the exhaust gas turbine, on the one hand, and an engine entry, on the other hand, an exhaust gas recirculation line arranged after the engine exit and before the engine entry is provided.

It is the object of the invention to provide an exhaust gas recirculation system for an internal combustion engine of the reciprocating piston design, which is implementable in a cost-effective manner and is distinguished by good effectiveness.

This and other objects are achieved according to the invention by an exhaust gas recirculation system for an internal combustion engine of the reciprocating piston design having an exhaust gas turbocharger unit, comprising an exhaust gas turbine and a supercharger, which internal combustion engine has a machine housing accommodating one or more cylinders having reciprocating pistons, which is provided with a suction unit and an exhaust gas outlet unit, which is connected to the exhaust gas turbine by way of an exhaust gas line. The exhaust gas line supplies at least a part of the exhaust gas stream to the suction unit via the exhaust gas recirculation system. The exhaust gas recirculation system has a pipe branch, which is connected to the exhaust gas line and is connected to an exhaust gas recirculation line with a control element interconnected. The exhaust gas recirculation line extends, on the one hand, with a first supply line section outside and, on the other hand, with a second supply line section in an interior of a suction unit container of the suction unit. An exhaust gas stream is conveyed by the second supply line section into the suction unit container for targeted mixing of exhaust gases with the air volume contained in the suction unit container.

The advantages primarily achieved by the invention can be considered to be that the exhaust gas recirculation system has an ideal design, which may be integrated using simple measures into an internal combustion engine, and thanks to this design, the exhaust gas recirculation system has an outstanding function with respect to the reduction of nitrogen oxides. It is achieved in a skilled manner that the exhaust gas recirculation system has the pipe branch, which is connected to the exhaust gas line and is connected to the exhaust gas recirculation line with the control element interconnected. It is to be emphasized in this case that the exhaust gas recirculation line extends, on the one hand, with a first supply line section outside and, on the other hand, with a second supply line section in the interior of a suction unit container of the suction unit. It plays a supporting role in this context that the exhaust gas stream is conveyed by way of the second supply line section into the suction unit container for targeted mixing of the exhaust gases with the air volume contained in the suction unit container.

The control element is effective if it has the throttle device, via which a calibrated exhaust gas stream reaches the interior of the suction unit container. It is functionally correct for this achievement of the object if the exhaust gas turbocharger unit is designed in such a manner that, in the entire characteristic map range of the internal combustion engine, the entry pressure into the exhaust gas turbine is greater than the pressure in the suction unit container. By way of example, the control element is also designed as a pulse-width-modulated switching valve, via which exhaust gas quantities, which are adapted in a manner controlled by the characteristic map and are regulated according to load and speed, are supplied to the suction unit container. A control element is furthermore advantageous if it is formed by an electric switching valve, which has open and close functions, and which releases exhaust gas quantities as a function of the characteristic map or characteristic curve along a characteristic curve of a drive system.

The first supply line section and the second supply line section of the exhaust gas recirculation line set standards, specifically in such a manner that the second supply line section extends over a substantial length of the suction unit container and is provided with axially spaced-apart, calibrated throttle openings, and the first supply line section has multiple curves to compensate for thermal expansion functions. Furthermore, the second supply line section is held in position on horizontal walls, which extend at a distance from one another, of the suction unit container with mediation of holding units.

To optimize the temperature of the exhaust gas stream of the exhaust gas recirculation system, a cooler for the hot exhaust gas stream is arranged in the pipe branch before the control element, this exhaust gas stream being cooled by way of the coolant water of the cooling system of the internal combustion engine, and passing the control element in the cooled state and arriving in the interior of the suction unit container via the first and the second supply line section. The cooler is designed according to the embodiment in that it has a cylindrical body which has, at a first end region, a coolant water entry device and an exhaust gas entry device and has, at a second end region, a coolant water exit device and an exhaust gas exit device. Furthermore, it is advantageous that radial bearing brackets for coolant water pipes, which extend in the axial direction, are provided adjacent to the coolant water entry device and the coolant water exit device.

The exhaust gas recirculation system is particularly suitable for an internal combustion engine, which is usable as an inboard or outboard motor for driving a boat and has at least one piston, which interacts with two crankshafts by way of two connecting rods. These crankshafts stand upright in a machine housing, which accommodates the crankshafts and the piston and influence a drive system, for example, a propeller of the boat. The internal combustion engine operates with the diesel method using direct injection and is provided with the exhaust gas turbocharger unit, comprising the exhaust gas turbine and the supercharger. The exhaust gas stream, which flows through the exhaust gas line connected to the outlet unit, is applied to the exhaust gas turbine. It contributes to the structural simplification and comprehensibility that the exhaust gas turbocharger unit and the exhaust gas line are arranged on an upper end face of the machine housing, and the suction unit container extends at least partially over the height of the machine housing. In addition, it is advantageous if the pipe branch is led away from the exhaust gas line and is connected to the control element, from which the first supply line section is laid to the second supply line section, which extends in the upright direction in the interior of the suction unit container and which has the axially spaced-apart calibrated throttle openings.

The exhaust gas recirculation system according to an aspect of the invention is active in an internal combustion engine of the reciprocating piston design, which has a housing accommodating one or more cylinders, which has a suction unit and an outlet unit connected to the exhaust gas line. This internal combustion engine is usable in many ways and operates as an internal combustion engine which is naturally aspirated or provided with an exhaust gas turbocharger unit, wherein the exhaust gas recirculation system has a pipe branch led away from the exhaust gas line, which is connected to an exhaust gas recirculation line with a control element interconnected. An advantageous structural principle is achieved if the exhaust gas recirculation line is connected to a supply line section extending in the interior of a suction unit container of the suction unit, which supply line section is represented as a pipe and is provided with one or more calibrated throttle openings. Finally, a cooler for the exhaust gas stream is provided in the pipe branch before the control element.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
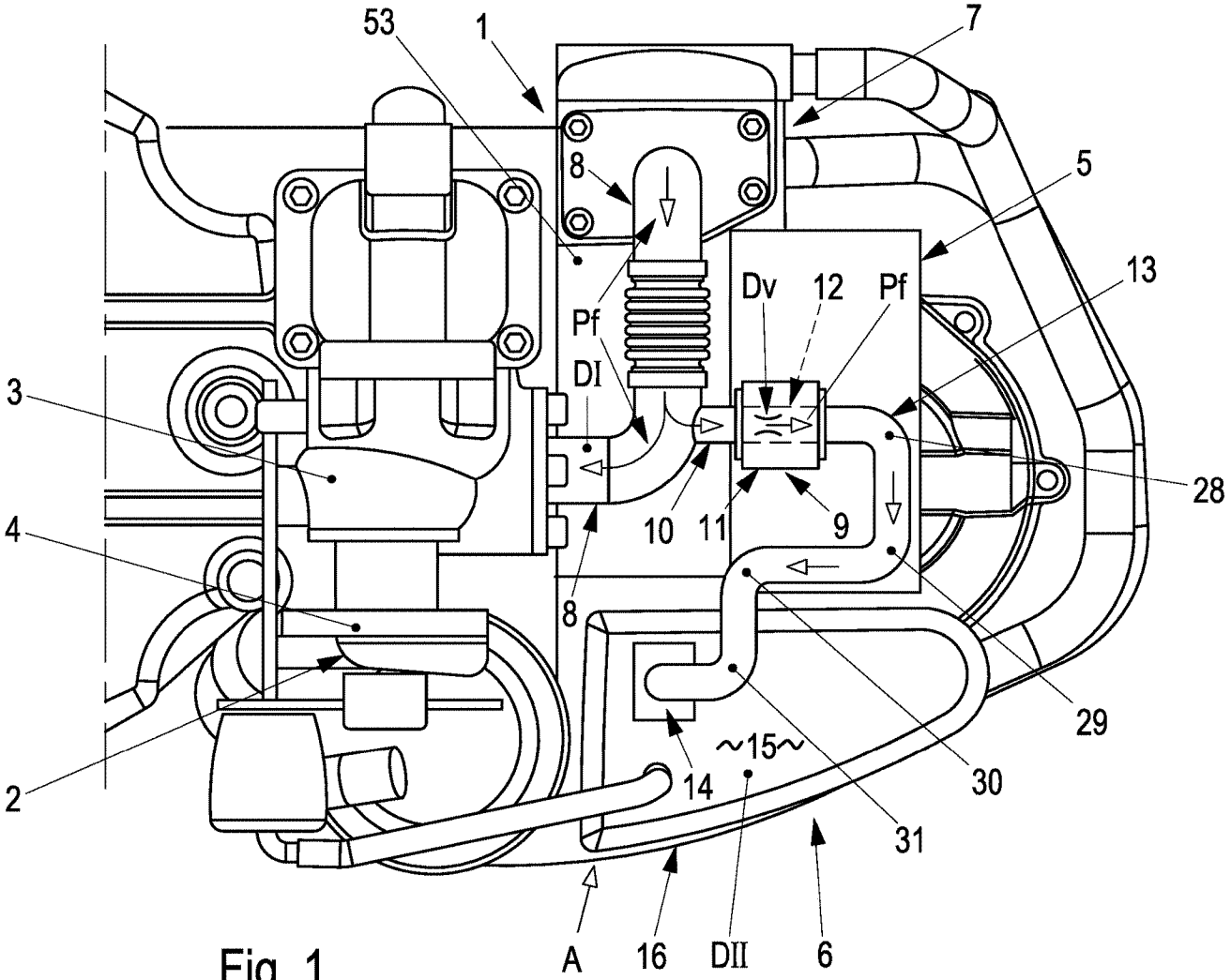
FIG. 1 is a schematic view from above of an internal combustion engine having an exhaust gas recirculation system.
Figure 2:
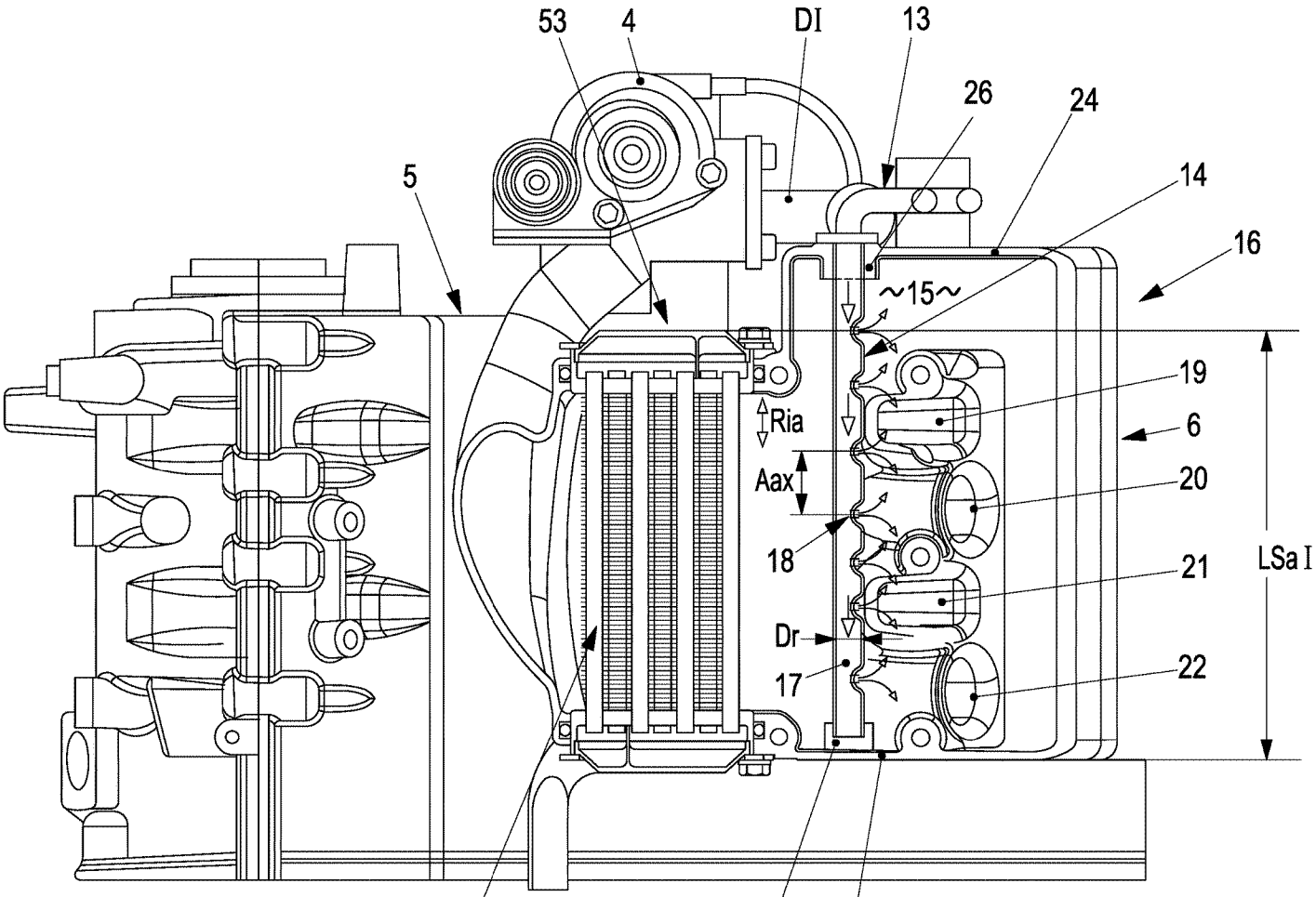
FIG. 2 is a view in arrow direction A of FIG. 1, partially in section.

An internal combustion engine 1 of the reciprocating piston design is provided with an exhaust gas turbocharger unit 2, which includes an exhaust gas turbine 3 and a supercharger 4. The internal combustion engine 1 has a machine housing 5 which accommodates one or more cylinders with reciprocating pistons, and which is provided with a cylinder housing and a cylinder head having suction channels leading to combustion chambers; the latter components are not shown. A suction unit 6 and an exhaust gas outlet unit 7 are attached to the machine housing 5; the exhaust gas outlet unit 7 is connected by way of an exhaust gas line 8 to the exhaust gas turbine 3. At least a part of an exhaust gas stream flowing in said exhaust gas line—arrow direction Pf—reaches, via the exhaust gas line 8, an exhaust gas recirculation system 9, which leads to the suction unit 6.

The exhaust gas recirculation system 9 has a pipe branch 10, which is connected to the exhaust gas line 8 and is connected to an exhaust gas recirculation line 12 with a control element 11 interconnected. The exhaust gas recirculation line 12 extends, on the one hand, with a first supply line section 13 outside and, on the other hand, with a second supply line section 14 in the interior 15 of a suction unit container 16 of the suction unit 6. The exhaust gas stream is conveyed into the suction unit container 16 by way of the second supply line section 14 for targeted mixing of the exhaust gas stream with the fuel-air volume contained in the suction unit container 16.

The control element 11 has a throttle device Dv, via which a calibrated exhaust gas stream reaches the interior 15 of the suction unit container 16. In this case, the exhaust gas turbocharger unit 2 can be designed in such a manner that, in the entire characteristic map range of the internal combustion engine 1, the entry pressure DI into the exhaust gas turbine 3 is greater than the pressure DII in the suction unit container 16. The control element 11 can additionally be a pulse-width-modulated switching valve, via which exhaust gas quantities, which are adapted in a manner controlled by the characteristic map and are regulated according to load and speed, are supplied to the suction unit container 16. However, it is also contemplated that the control element 11 is formed by an electric switching valve, which has open and close functions, and which releases exhaust gas quantities as a function of the characteristic map or characteristic curve along a characteristic curve of a drive system. The drive system can be, for example, a propeller for propulsion of a boat—EP 2 696 054 A1.

The second supply line section 14 of the exhaust gas recirculation line 12 is formed by a pipe 17 having a diameter Dr of, for example, between 6-15 mm, and it extends over a substantial length LSaI of the suction unit container 16. The pipe 17 is provided with multiple throttle openings 18, which are arranged at an axial distance Aax in relation to one another and are calibrated. The throttle openings 18 face in the direction of connection channels 19, 20, 21, 22—four-valve technology—which are produced from one piece with the suction unit container 16 and lead to inlet channels in the cylinder head—not shown. In addition, a charge air cooler 23 is integrated into the suction unit 6, wherein suction unit 6 and charge air cooler 23 are combined to form a module. The suction unit container 16 has two walls 24 and 25, which extend with vertical distance in relation to one another and on which the second supply line section 14 is held in position with mediation of first and second holding units 26 and 27. In addition, the first supply line section 13 is provided with multiple curves 28, 29, 30, and 31—FIG. 1—which are used to compensate for thermal expansion functions.

Figure 3:
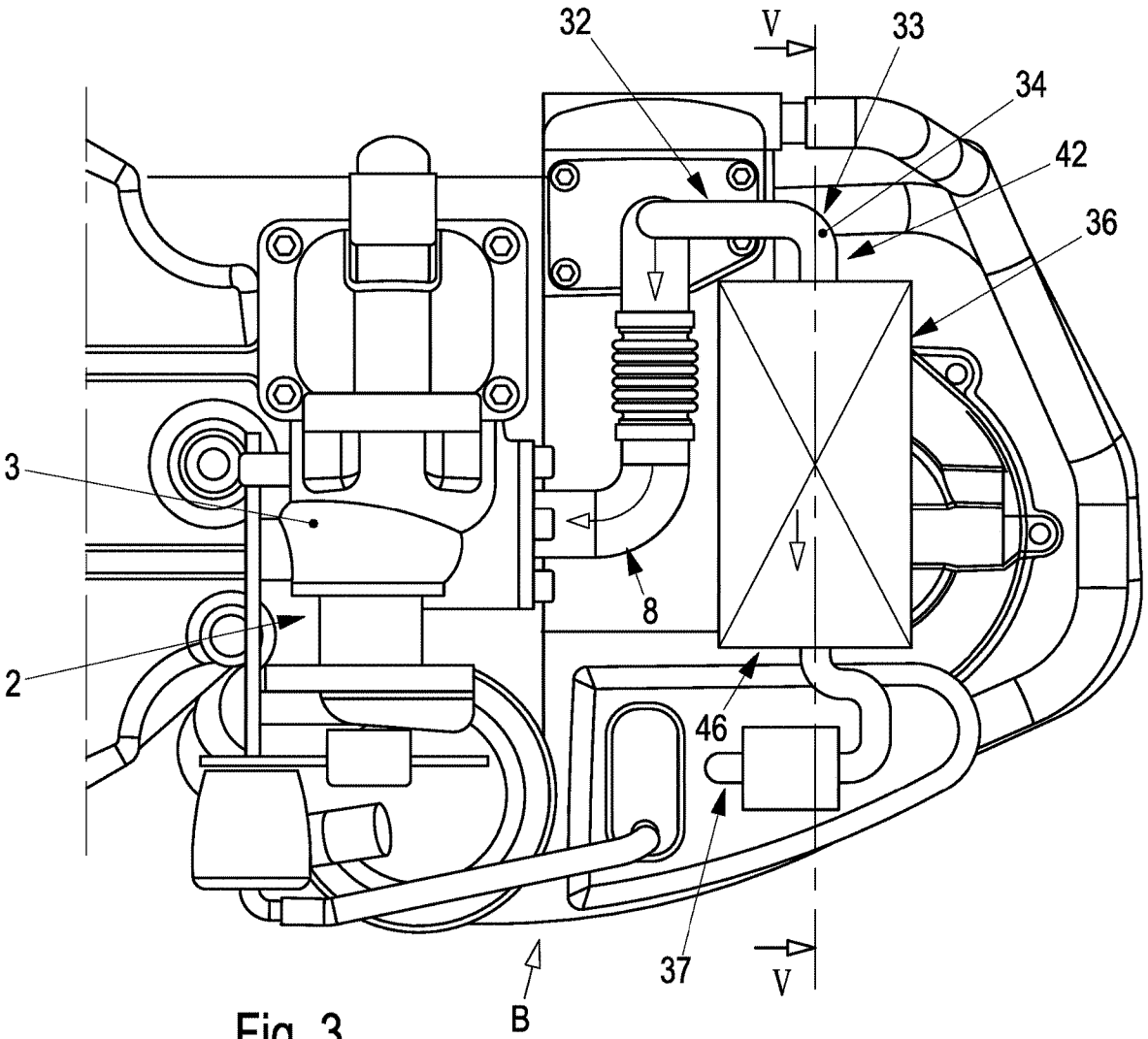
FIG. 3 is a view corresponding to FIG. 1.
Figure 4:
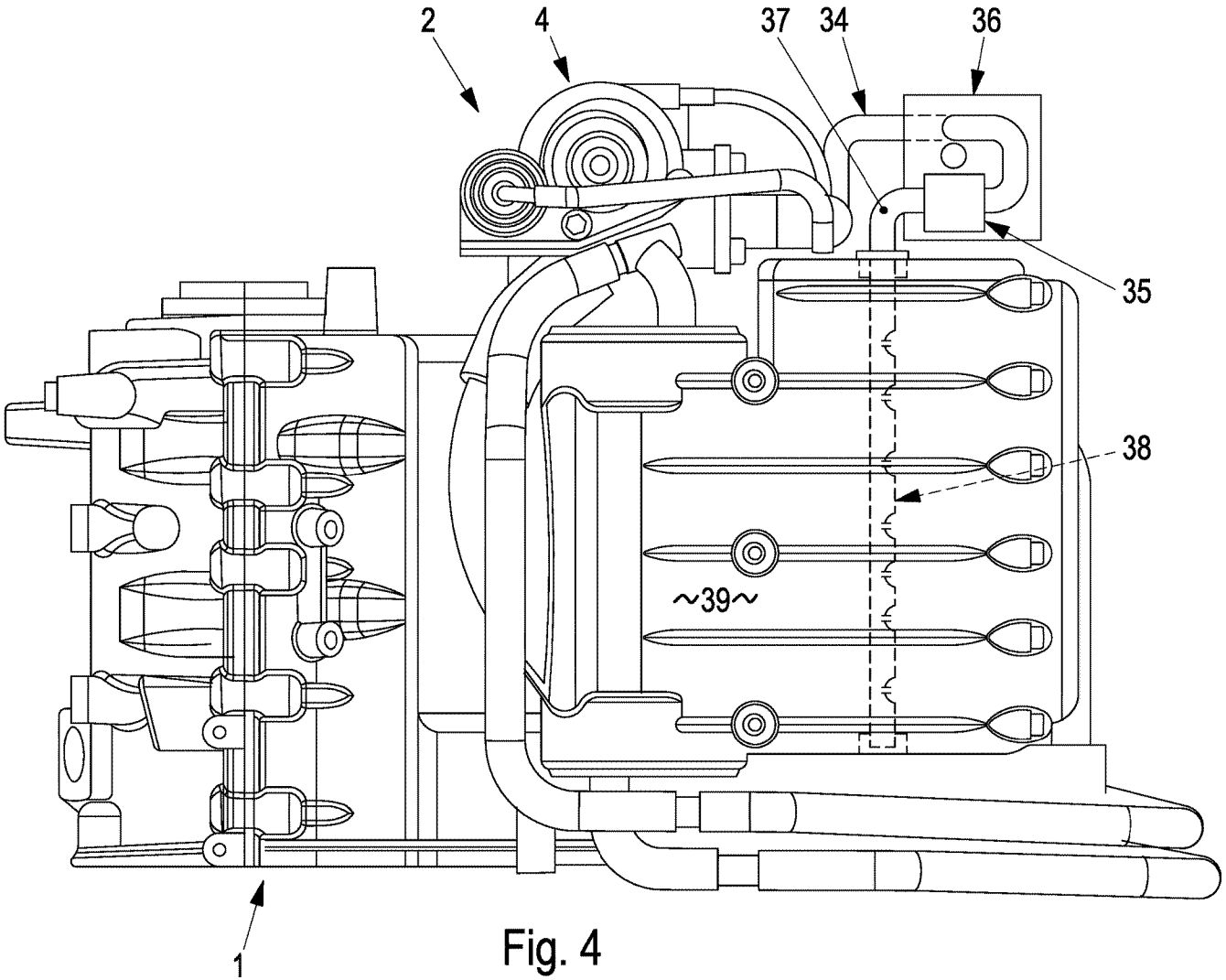
FIG. 4 is a view in arrow direction B of FIG. 3.
Figure 5:
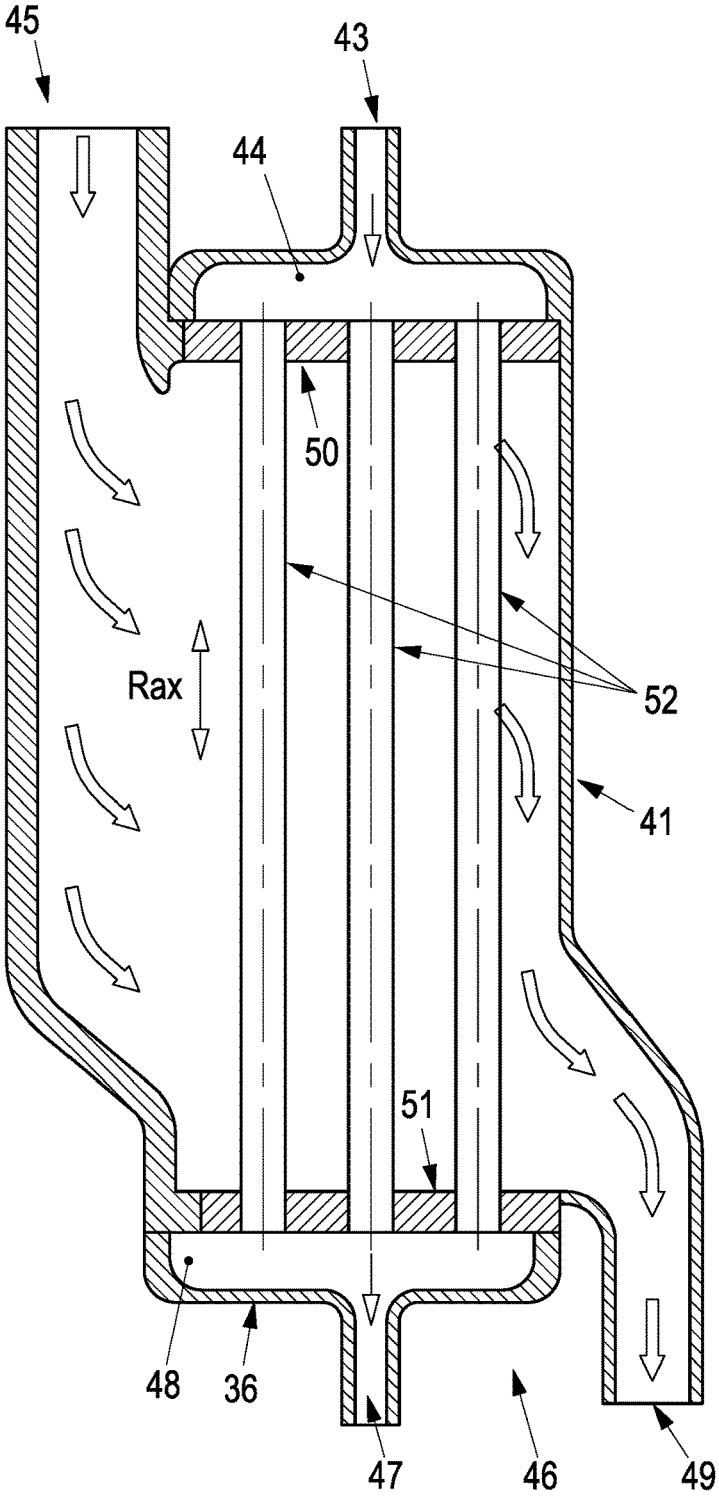
FIG. 5 is a schematic section view taken along line V-V of FIG. 3.

According to FIG. 3, a cooler 36 for the hot exhaust gas stream is arranged in a pipe branch 32 of an exhaust gas recirculation system 33 of an exhaust gas line 34 before a control element 35, the exhaust gas stream being cooled by means of the coolant water of a cooling system (not shown in its entirety) of the internal combustion engine 1. In the cooled state, the exhaust gas stream reaches, via the control element 35, a first supply line section 37 and a second supply line section 38 in an interior 39 of a suction unit container 40, where the cooled exhaust gas stream is admixed with the fuel-air volume present therein. The cooler 36 has, according to FIG. 5, a cylindrical body 41, for example, which has, at a first end region 42, a coolant water entry device 43 having a supply chamber 44 and an exhaust gas entry device 45 and, at a second end region 46, a coolant water exit device 47 having a discharge chamber 48 and an exhaust gas exit device 49. Radial bearing brackets 50 and 51, which accommodate multiple coolant water pipes 52, are inserted into the body 41 adjacent to the coolant water entry device 43 and the coolant water exit device 47. They extend in the axial direction—Rax—of the body 41.

The exhaust gas recirculation systems 9 and 33 according to FIGS. 1-4 are suitable, inter alia, for internal combustion engines which are used as inboard or outboard motors, wherein the corresponding internal combustion engine 1 has at least one piston, which interacts with two crankshafts by way of two connecting rods. A construction of this type is disclosed in EP 2 857 054 A1, already cited above. These crankshafts stand upright in the machine housing 5, which accommodates the crankshafts and the piston, and influence a drive system, which acts on a propeller of a boat. The internal combustion engine 1 operates in the diesel method with direct injection, and it is provided with the exhaust gas turbocharger unit 2, which includes the exhaust gas turbine 3 and the supercharger 4. The exhaust gas stream, which is guided in the exhaust gas line 8 connected to the exhaust gas outlet unit 7, is applied to the exhaust gas turbine 3. In this embodiment, the exhaust gas turbocharger unit 2 and the exhaust gas line 8 are arranged on an upper end face 53 of the machine housing 5. The suction unit container 16 extends over approximately the height of the machine housing 5, and the pipe branch 9 is led away from the exhaust gas line 8—FIG. 1—and connected to the control element 11, from which the first supply line section 13 is laid to the second guide section 14, which extends in the upright or vertical direction Ria from top to bottom in the interior 15 of the suction unit container 16. The second supply line section 14 is provided with the throttle openings 18, which are arranged at distance Aax in relation to one another.

Figure 6:
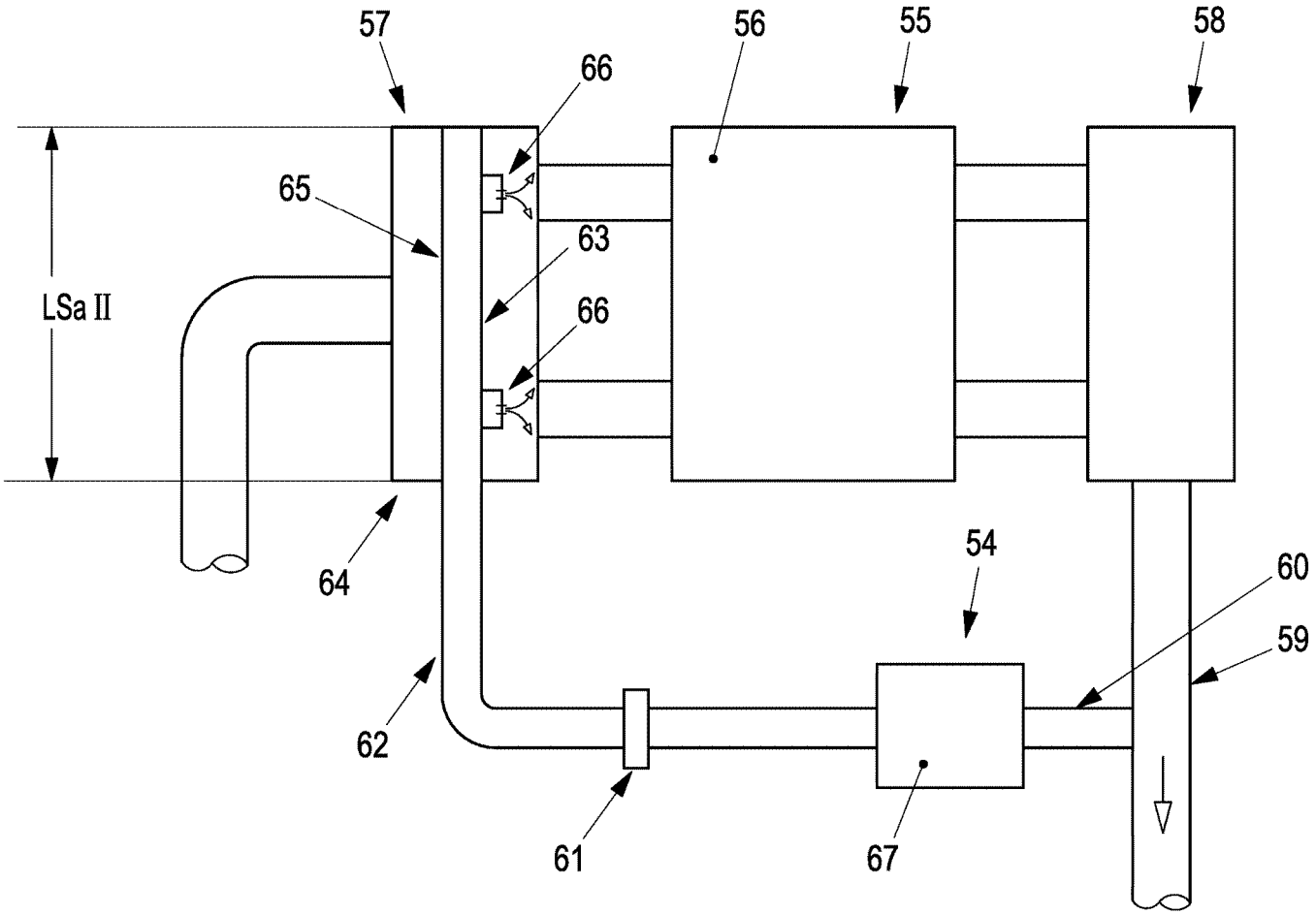
FIG. 6 is a schematic illustration of an internal combustion engine having an exhaust gas recirculation system.

An exhaust gas recirculation system 54 according to FIG. 6 is connected to an internal combustion engine 55 of the reciprocating piston design, which has a machine housing 56 accommodating one or more cylinders having pistons—not shown. The machine housing 56 has a suction unit 57 and an exhaust gas exit unit 58, which is provided with an exhaust gas line 59. The internal combustion engine 54 operates as an internal combustion engine which is naturally aspirated or provided with exhaust gas turbocharging—not shown. The exhaust gas recirculation system 54 has a pipe branch 60, which is led away from the exhaust gas line 59 and which is connected to an exhaust gas recirculation line 62 with a control element 61 interconnected—approximately corresponding to the control elements 11 and 35. The exhaust gas recirculation line 62 is connected to a supply line section 65—similar to the second supply line section 38—extending in the interior 63 of a suction unit container 64 of the suction unit 57. This supply line section 65 is embodied like a pipe having axially spaced-apart calibrated throttle openings 66 and extends in the interior 63 of the suction unit container 64, and does so over a substantial length LSaII of the latter. Finally, a cooler 67 for the exhaust gas stream conducted in the interior 63 is provided in the pipe branch 60.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust gas recirculation system for an internal combustion engine of a reciprocating piston design having an exhaust gas turbocharger unit comprising an exhaust gas turbine and a supercharger, the internal combustion engine having a machine housing that accommodates one or more cylinders having reciprocating pistons, the exhaust gas recirculation system comprising:

a suction unit;

an exhaust gas outlet unit;

an exhaust gas line coupling the exhaust gas outlet unit to the exhaust gas turbine, wherein the exhaust gas line supplies a part of an exhaust gas stream to the suction unit via the exhaust gas recirculation system;

a pipe branch of the exhaust gas recirculation system connected to the exhaust gas line;

an exhaust gas recirculation line coupled to the pipe branch;

a control element interconnecting the pipe branch and the exhaust gas recirculation line, wherein the exhaust gas recirculation line extends, on one hand, with a first supply section outside and, on another hand, with a second supply line section in an interior of, a suction unit container of the suction unit, wherein the control element has a throttle device, via which a calibrated exhaust gas stream reaches the interior of the suction unit container, whereby an exhaust gas stream conveyed by the second supply line section into the suction unit container provides targeted mixing of exhaust gases with air volume contained in the suction unit container.

2. The exhaust gas recirculation system as claimed in claim 1, wherein the exhaust gas turbocharger unit is designed such that, in an entire characteristic map range of the internal combustion engine, the entry pressure into the exhaust gas turbine is greater than pressure in the suction unit container.

3. The exhaust gas recirculation system as claimed in claim 1, wherein the control element is a pulse-width-modulated switching valve, via which exhaust gas quantities, which are adapted in a manner controlled by a characteristic map and are regulated according to speed, are supplied to the suction unit container.

4. The exhaust gas recirculation system as claimed in claim 1, wherein the control element is formed by an electric switching valve, which has open and close functions, and which releases exhaust gas quantities as a function of a characteristic map or characteristic curve along a characteristic curve of a drive system.

5. The exhaust gas recirculation system as claimed in claim 1, wherein the second supply line section of the exhaust gas recirculation line extends over a substantial length of the suction unit container and is provided with calibrated throttle openings arranged with axial distance in relation to one another.

6. The exhaust gas recirculation system as claimed in claim 1, wherein the first supply line section of the exhaust gas supply line has multiple curves to compensate for thermal expansion functions.

7. The exhaust gas recirculation system as claimed in claim 1, wherein the second supply line section is held in position on walls, which extend at a distance from one another, of the suction unit container with mediation of holding units.

8. The exhaust gas recirculation system as claimed in claim 1, wherein a cooler for the hot exhaust gas stream is arranged in the pipe branch before the control element, this exhaust gas stream being cooled by coolant water of a cooling system of the internal combustion engine, and passing the control element in the cooled state and arriving in the interior of the suction unit container via the second supply line section.

9. The exhaust gas recirculation system as claimed in claim 8, wherein the cooler comprises a cylindrical body which has, at a first end region, a coolant water entry device and an exhaust gas entry device and has, at a second end region, a coolant water exit device and an exhaust gas exit device.

10. The exhaust gas recirculation system as claimed in claim 9, wherein, adjacent to the coolant water entry device and the coolant water exit device, radial bearing brackets are provided inside the body of the cooler, which are used to accommodate coolant water pipes extending in the axial direction of the body.

11. An exhaust gas recirculation system for an internal combustion engine of a reciprocating piston design having an exhaust gas turbocharger unit comprising an exhaust gas turbine and a supercharger, the internal combustion engine having a machine housing that accommodates one or more cylinders having reciprocating pistons, the exhaust gas recirculation system comprising:

a suction unit;

an exhaust gas outlet unit;

an exhaust gas line coupling the exhaust gas outlet unit to the exhaust gas turbine, wherein the exhaust gas line supplies a part of an exhaust gas stream to the suction unit via the exhaust gas recirculation system;

a pipe branch of the exhaust gas recirculation system connected to the exhaust gas line;

an exhaust gas recirculation line coupled to the pipe branch;

a control element interconnecting the pipe branch and the exhaust gas recirculation line, wherein the exhaust gas recirculation line extends, on one hand, with a first supply section outside and, on another hand, with a second supply line section in an interior of, a suction unit container of the suction unit, whereby an exhaust gas stream conveyed by the second supply line section into the suction unit container provides targeted mixing of exhaust gases with air volume contained in the suction unit container, wherein the internal combustion engine has at least one piston, which interacts with two crankshafts via two connecting rods, which crankshafts stand upright in the machine housing, the machine housing accommodating said crankshafts and the piston, wherein the internal combustion engine operates in a diesel method with direct injection, and is provided with the exhaust gas turbocharger unit, comprising the exhaust gas turbine and the supercharger, which exhaust gas turbine is driven by the exhaust gas stream flowing in the exhaust gas line, which is connected to the exhaust gas outlet unit, wherein the exhaust gas turbocharger unit and the exhaust gas line are arranged on an upper end face of the machine housing, and wherein the suction unit container extends at least partially over the height of the machine housing, and wherein in addition the pipe branch is led away from the exhaust gas line and is connected to the control element, from which the first supply line section is laid to the second supply line section, which extends in the upright direction in the interior of the suction unit container and which has the throttle openings arranged with axial distance in relation to one another.

* * * * *